US012016409B2

(12) United States Patent
Halerz-Sroczynski

(10) Patent No.: US 12,016,409 B2
(45) Date of Patent: Jun. 25, 2024

(54) GARMENT HAVING SAFETY GROOVES

(71) Applicant: Marla Halerz-Sroczynski, Chicago, IL (US)

(72) Inventor: Marla Halerz-Sroczynski, Chicago, IL (US)

( * ) Notice: Subject to any disclaimer, the term of this patent is extended or adjusted under 35 U.S.C. 154(b) by 228 days.

(21) Appl. No.: 17/033,551

(22) Filed: Sep. 25, 2020

(65) Prior Publication Data

US 2021/0093026 A1 Apr. 1, 2021

Related U.S. Application Data

(60) Provisional application No. 62/906,699, filed on Sep. 26, 2019.

(51) Int. Cl.
*A41D 27/00* (2006.01)
*A41D 1/02* (2006.01)

(52) U.S. Cl.
CPC ..... *A41D 27/00* (2013.01); *A41D 1/02* (2013.01)

(58) Field of Classification Search
CPC ..... A41D 27/00; A41D 1/02; A47G 9/068
See application file for complete search history.

(56) References Cited

U.S. PATENT DOCUMENTS 5,161,258 A * 11/1992 Coltrain ..... A41D 11/00 2/108
5,213,366 A * 5/1993 Sweger, Jr. ..... B60R 22/14 297/483
5,429,418 A * 7/1995 Lipper ..... B60R 22/105 297/483
6,336,221 B1 * 1/2002 Blauer ..... A41D 31/102 2/904
6,449,770 B1 * 9/2002 Taylor ..... A41D 13/0007 128/869
6,817,033 B2 * 11/2004 Bailey ..... A41B 13/06 2/69.5
7,131,703 B1 * 11/2006 Sheridan ..... B60R 22/14 297/485
7,409,726 B2 * 8/2008 Bahm ..... A41B 13/00 2/49.1
7,954,172 B2 * 6/2011 Hepler ..... B60R 22/14 2/75
8,225,422 B1 * 7/2012 McSparron ..... A41B 13/005 2/69.5
D760,477 S * 7/2016 Adamo ..... D2/828
(Continued)

OTHER PUBLICATIONS

Onekid, Car Seat Safety Road Coat® Down Jacket—AQUA, retrieved from the internet on Oct. 9, 2020, 4 pages. https://onekid.com/products/seat-safety-road-coat-down-jacket-aqua?variant-6298207387680&ref=Store Ya&utm_source=stry&utm_medium=trafb&utm_term=pla-295478164499&utm_campaing=storeya51.
(Continued)

*Primary Examiner* — Alissa L Hoey
(74) *Attorney, Agent, or Firm* — DLA PIPER LLP (US)

(57) ABSTRACT

Disclosed herein are garments having one or more cuts made in the outer layer of the garment and one or more safety grooves beneath the outer layer. The safety grooves may define a path for one or more contact surfaces of a harness. The cuts and safety grooves may secure a person inside a harness by reducing and/or eliminating the amount of material between the harness contact surfaces and the body or inner layer of clothing of the person wearing the garment.

12 Claims, 6 Drawing Sheets

(56) References Cited

U.S. PATENT DOCUMENTS

| | | | | |
|---|---|---|---|---|
| 9,420,833 | B2 * | 8/2016 | Jenkins | A41D 11/00 |
| 9,498,007 | B2 * | 11/2016 | Rizk | A47D 15/006 |
| 10,342,271 | B1 * | 7/2019 | Douglas | A41D 1/02 |
| 10,660,454 | B2 * | 5/2020 | Fosse | A47D 13/025 |
| 10,779,585 | B2 * | 9/2020 | Autard | A41D 11/00 |
| 11,344,070 | B2 * | 5/2022 | Sandoval | A41D 11/00 |
| 2005/0017566 | A1 * | 1/2005 | Rizk | A41D 11/00 297/465 |
| 2008/0252132 | A1 * | 10/2008 | Thomson | A41D 13/00 2/102 |
| 2015/0181953 | A1 * | 7/2015 | Brown | B60N 2/265 2/69 |
| 2018/0125124 | A1 * | 5/2018 | Jylkka-Tesler | A41D 27/136 |
| 2018/0184730 | A1 * | 7/2018 | Autard | A41D 27/04 |
| 2019/0116899 | A1 * | 4/2019 | Williams | A41D 1/02 |
| 2019/0200780 | A1 * | 7/2019 | Fosse | A41D 11/00 |
| 2019/0307179 | A1 * | 10/2019 | Beard | A41D 3/00 |
| 2020/0068963 | A1 * | 3/2020 | Oliker | A41D 11/00 |
| 2020/0383399 | A1 * | 12/2020 | Rizk | A41D 1/02 |

OTHER PUBLICATIONS

The North Face, Women's Arrowood Triclimate® Jacket, retrieved from the internet Oct. 9, 2020, 4 pages. https://www.thenorthface.com/shop/womens-arrowood-triclimate-jacket-nf0a3oc4#hero=0.

* cited by examiner

GARMENT HAVING SAFETY GROOVES

CROSS REFERENCE TO RELATED APPLICATIONS

This application claims the benefit of U.S. Provisional Application Ser. No. 62/906,699 filed Sep. 26, 2019, the entire contents of which are incorporated by reference.

FIELD

The present disclosure relates generally to clothing and outerwear, in particular, outerwear having safety features.

BACKGROUND

Various types of garments are available to consumers in the marketplace. In colder climates, thicker garments are desirable because they provide insulation against loss of body heat and provide protection from cold weather. While important for keeping the wearer warm in cold weather, the outer insulation layers included in thick garments may create dangerous conditions, especially during travel. By separating a person wearing a harness (e.g., a seatbelt, five point harness included in a car seat, and the like), from the harness itself, garments can interfere with a harness' ability to properly secure the person in a seat during travel. There is therefore a need to develop garments that can accommodate harnesses to safely secure people wearing garments during travel.

BRIEF DESCRIPTION OF THE DRAWINGS

Various objectives, features, and advantages of the disclosed subject matter can be more fully appreciated with reference to the following detailed description of the disclosed subject matter when considered in connection with the following drawings, in which like reference numerals identify like elements.

DETAILED DESCRIPTION OF ONE OR MORE EMBODIMENTS

As used herein, the term "garment" may include any article of clothing that may be worn as layer of clothing to keep the wearer warm, protect the wearer, and the like and may include but is not limited to, a coat, jacket, winter coat, hooded sweatshirt, sweatshirt, crewneck sweatshirt, V-neck sweatshirt, vest, shirt, sweater, shawl, wrap, blanket, snow suit, jumper, ski suit, cape, and the like.

As used herein, the term "harness" may include, but is not limited to, any safety system and/or restraint system including straps, belts, restraints, clips, buckles, and the like. Harness may include a five point harness system, a three point harness system, a seat belt, and the like. A harness may be a safety feature of a transportation vehicle (e.g., a car, plane, train, and the like), stroller, carrier, amusement ride, playground ride, cart, car seat, ride on, and the like.

As used herein, the term "portions of harness" may include, but is not limited to, any surface of a harness that comes into contact with a person or clothing worn by a person while that person is wearing a harness. Portions of harness may include surfaces on various components of the harness including straps, belts, restraints, clips, buckles, and the like.

As used herein, the term "harness contact area" may include, but is not limited to, any area on the body of a person and/or on the garment being worn by the person that comes into contact with the harness when the harness is attached to the user to restrain the user.

The garment with safety grooves may be manufactured and used as described below and as shown in the figures. However, the garment is not limited to the embodiments shown in the figures and described below since the safety grooves may have a different shape or size than disclosed in the embodiments and the safety grooves or cuts may be located at different locations of the garment.

Figure 1:
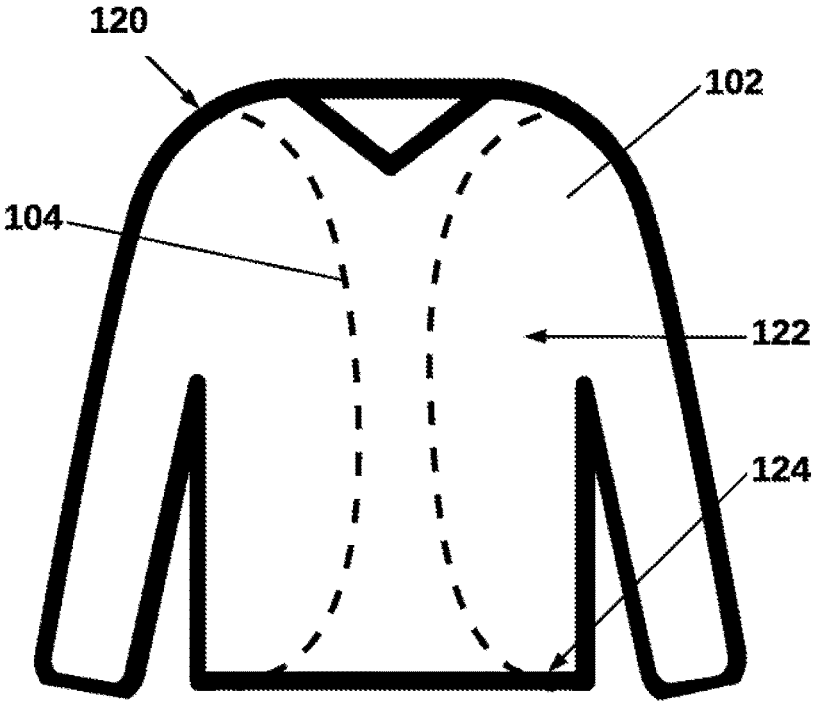
FIG. 1 depicts an exemplary garment having safety grooves.

Referring now to the figures, FIG. 1 illustrates a garment 102 having one or more cuts 104 in an outer layer of the garment 102. One or more safety grooves included in the garment 102 may be accessed through the one or more cuts 104. The garment 102 may be made of various materials including natural and/or synthetic clothing materials. Natural clothing materials may include woven fibers made of cotton, flax, wool, ramie, silk, and the like. Synthetic clothing materials may include woven fibers made of nylon, polyester, spandex, and the like. The garment 102 may include a shoulder portion 120 at the top of the garment 102 that is worn on the shoulders of a person wearing the garment 102; a torso section 122 at the middle of the garment 102 worn over the chest and torso of a person wearing the garment 102; and a bottom hem 124 at the base of the garment 102 worn above or over the waistline of a person wearing the garment 102. The one or more cuts 104 may be placed at any location throughout the garment 102. In various embodiments, the one or more cuts 104 may be made in the garment 102 at areas that align with and track one or more harness contact areas that intersect with one or more portions of the harness. The one or more harness contact areas are areas on the body of a person (and thus also on the garment being worn by the person) that come into contact with the harness when the harness is attached to the user to restrain the user.

To reduce and/or eliminate the amount of material between the harness and the person wearing the harness, portions of the harness may be inserted through the one or more cuts 104 into one or more safety grooves. In one embodiment, the safety grooves include a lined track sewn into the inside of the garment 102. The lined track may be made out of any combination of natural and or synthetic material (e.g., a natural fabric, synthetic fabric, foam, or other material). To minimize the material between the harness and the person wearing the harness, the material used to form the lined track may be a thin fabric, a dense fabric, and or a compressible fabric. For example, the thin fabric and or the dense fabric may have a thickness that is less than the thickness of the garment 102 (e.g., between 0.001-1.1 inches or any other thickness that is less than the thickness of the garment 102). The compressible fabric may compress down to a thickness that is less than the thickness of the garment 102 (e.g., between 0.001-1.1 inches or any other thickness that is less than the thickness of the garment 102) when the harness is within the lined track of the safety groove and secured tightly over the person wearing the garment 102. In other embodiments, the material used to form the lined track of the safety grooves may be the same thickness as the garment 102. Additionally, the safety grooves may include no lining.

To enhance the fit between the garment 102 and the portions of the harness and structure including the harness (i.e., a seat or car seat), the torso section 122, shoulder portion 120, and any other portion of the garment 102 may also be formed from the thin fabric, dense fabric, and or compressible fabric to reduce the distance between the harness and or seat and the person wearing the garment 102. For example, the back portion of the garment 102 opposite the torso section 122 may be formed from the thin fabric, dense fabric, and or compressible fabric to reduce the distance between the person wearing the harness and a seat (e.g., a car seat) or other structure that uses the harness to hold the person securely in position. One or more portions of the garment 102 covering one or more harness contact areas and or the seat or other structure contact areas (e.g., the back, shoulders, torso portions of the garment 102) may also be thinned relative to the other parts of the garment 102 and or made from the thin fabric, the dense fabric the compressible fabric, and or any other thin, dense, or compressible material. The thinned portions of the garment 102 may have a thickness that is less than the thickness of the garment 102 (e.g., between 0.001-1.1 inches or any other thickness that is less than the thickness of the garment 102) to ensure the portions of the person's body that contact the harness and or seat or other structure are tight against the harness and or seat or other structure. For example, the back of a snow suit, winter coat, or other heavy garment 102 may be formed from the thin fabric, dense fabric, compressible fabric, and/or other thin, dense, and or compressible material that is thinner than the other portions of the garment 102 to limit the amount of material between a person wearing the heavy garment and the back of a seat.

Other embodiments of the garment 102 may not have any thinned portions. The thickness of different areas of the garment 102 and or the thickness of the lined track included in the safety grooves may be determined by safety testing. For example, crash testing simulating the effects of a car crash on a crash dummy wearing the garment 102 while inside a car seat with one or more portions of the harness of the car seat inserted into one or more safety grooves included in the garment 102.

By reducing and/or eliminating the amount of material between a harness and/or portion of harness and the person wearing the harness, the garment 102 secures the person inside the harness without requiring the person to remove their outer layer of clothing. The garment 102 accommodates portions of harness and/or an entire harness beneath the outer layer of clothing, therefore, is more convenient, comfortable, and safer than removing an outer layer of clothing or other alternative methods of bringing the portions of harness closer to the body of the wearer. Accommodating a harness and/or portions of harness inside the garment 102 may prevent a person from ejecting from the harness during a sudden change in position (e.g., during a sudden stop, accident, quick turn, and the like). By securing a person inside the harness, the garment 102 may also keep the person in a centered and stable position (e.g., with the person's head aligned over the center of their body) to optimally absorb impact from the front, side, back, or any other direction. In particular, the garment 102 may align a person's head and other body parts with safety features of a car seat and/or air bag system. For example, the garment 102 may align a person's head with side impact head protection panels and/or cushions included in a car seat and/or front, back, and/or side air bags included in an automobile or other vehicle. The garment 102 may also provide a layer of protection from debris (e.g., glass, metal, plastic, and the like) that may impact the child during a crash.

The garment 102 allows the efficiency, benefits, and purposes of being properly secured inside of the harness to be retained even when a person is wearing a thick, bulky, and/or puffy garment. In particular, the garment 102 may reduce the amount of time and effort caregivers spend securing children inside car seat harnesses, while also ensuring the child is kept warm by their coat or other outer layer of clothing and secured tightly inside the harness. In various embodiments, the garment 102 allows caregivers to avoid the tedious, time consuming, difficult, and uncomfortable process of removing a child's outer layer of clothing every time they get into a car seat or other harness and putting the outer layer back on the child every time they get out of the car seat or other harness. By placing the harness beneath a child's outer of clothing, the garment 102 also avoids additional complications of having to cover the child over the harness, for example, by using their outer layer of clothing as a blanket, stuffing clothing inside or around the harness, and the like.

The garment 102 may be particularly useful for securing a person in a car seat in a cold climate. For example, the garment may keep people that are unable to get out of the harness for an extended period of time (e.g., after the driver of the car passed out, while the person is waiting in the car, and the like) warm while inside the harness. The garment 102 may also deter a child from opening a harness closure mechanism and/or removing their safety harness by concealing the harness closure mechanism and/or the harness beneath the garment 102.

In various embodiments, the safety grooves may also have one or more functions that are not directly related to enhancing safety. For example, the cuts 104 made in the garment 102 may also make bathroom breaks and, for young children, diaper changes more efficient. The cuts 104 create paths through the garment 102 for people to access their inner layer of clothing and/or body and/or caregivers to access diapers, thereby allowing people to use the restroom and caregivers to change a diaper without removing the outer layer of clothing. The garment 102 may also be used to accommodate harnesses placed over animals and/or other objects to enable additional medical, industrial, and/or recreational uses. For example, more efficient and/or humane ways of harnessing animals for transportation and/or agricultural purposes. The garment 102 may also bring items other than the portions of harness closer to the body of the wearer. For example, one or more straps of a backpack, purse, shoulder bag, fanny pack, waist pack, and the like may be inserted into one or more safety grooves to increase comfort and secure the accessory on the person's body.

Figure 2:
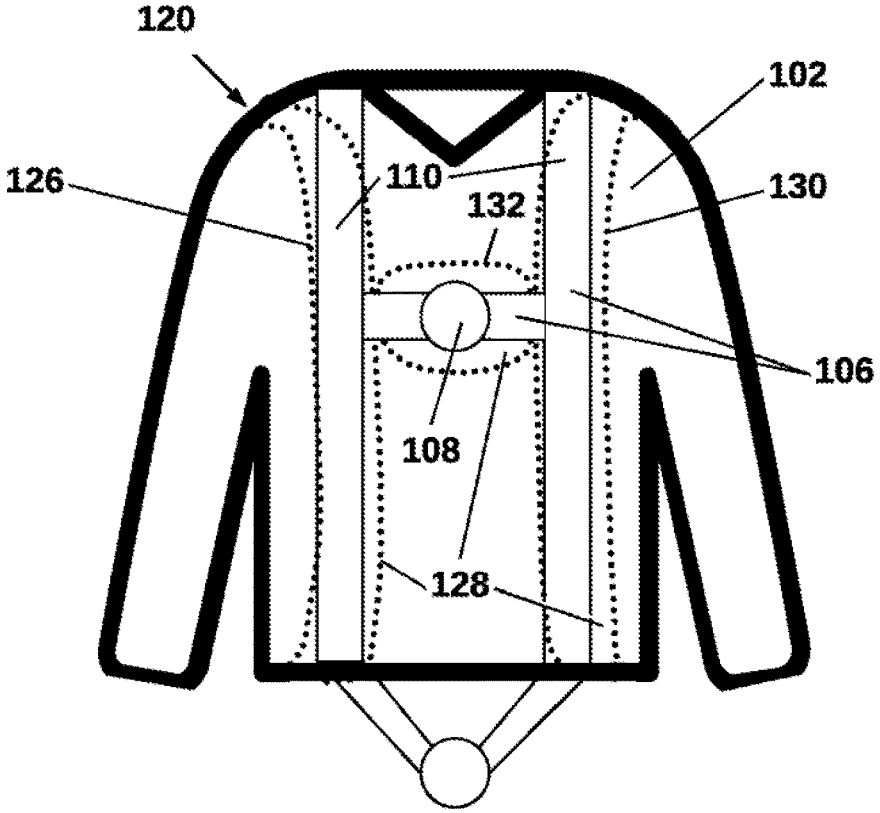
FIG. 2 depicts the exemplary garment having safety grooves and a contact area of a five point harness with the garment.
Figures 3A, 3B:
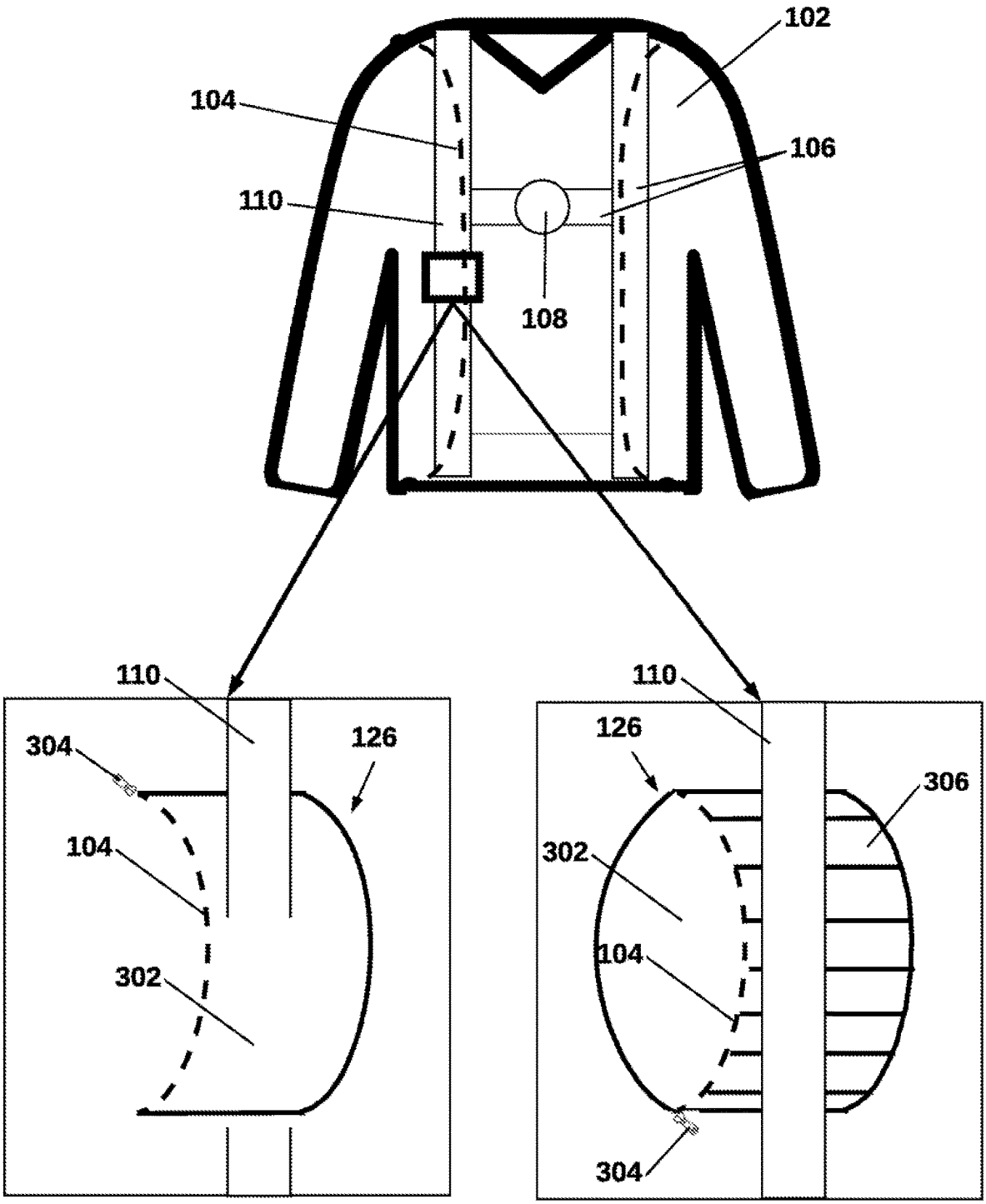
FIGS. 3A-B illustrate a close up view of an exemplary safety groove and its interaction with a contact area of a harness.

In various embodiments, one or more safety grooves beneath the garment material may be accessed through the cuts 104. The safety grooves may be the same and/or different lengths relative to the cuts 104. Some cuts 104 are longer than their corresponding safety grooves and some safety grooves are longer than their corresponding cuts. To reduce the amount of material and distance separating a person wearing the garment 102 from the harness, the harness may pass through the cuts 104 and the one or more portions of the harness, such as harness straps, may be placed inside the safety grooves. Safety grooves may be lined paths and/or un-lined openings. Lined safety grooves allow one or more portions of harness to be inserted into the safety grooves and rest against a thin liner in contact with a person's body or inner layer of clothing. Un-lined safety grooves may extend all the way through the garment to place the one or more portions of harness in direct contact with a person's body or inner layer of clothing. Additionally, the safety grooves may be partially lined. Partially lined safety grooves may include a piece of material that lines one side of the groove. Partially lined safety grooves may also include a piece of material that extends from one side of the groove to the other side of the groove. For example, a piece of material may extend along and or across one or more sides of the safety groove to allow the garment and or safety groove to maintain its shape when the safety groove is opened and or unfastened. The piece of material may be a removable or non-removable strap and or elastic or non-elastic material that may be configured to extend along and or across one or more sides of the safety groove when the safety groove is open and or unfastened (i.e., has no harness portion inside the groove) and retract and or be removed from the side of the safety groove when the groove is closed and or fastened (i.e., has a harness portion inside the groove). The piece of material that forms the partially lined groove may also remain attached to the side of the groove when the safety grooves are closed and or being used to hold a portion of the harness. The thickness of the piece of material may be limited to between 0.001 and 0.1 inches to ensure the piece of material does not negate the safety of the harness by increasing the distance between the harness and the person wearing the harness. FIGS. 2 and 3A-B below show the safety grooves in more detail.

As shown in FIG. 1, the one or more cuts 104 may extend from the back of the shoulder portion of the garment and down the torso section of the embodiment in FIG. 1. The cuts 104 may be curved to allow the harness straps to sit flush against an inner layer of clothing and/or the body of the person wearing the garment. In various embodiments, the cuts 104 curve inwards towards the center of the garment 102. In various embodiments, the inner layer of clothing may be a lining built into the garment, a thin jacket, a shirt, and the like. The cuts 104 may be opened and closed to allow and restrict access to the safety grooves using any known clothing fastener including zippers, full length Velcro extending the entire length of the cut 104, segmented Velcro placed at various intermediate points along the length of the cut 104, buttons, snaps, full length magnets extending the entire length of the cut 104, magnet segments placed a various intermediate points along the length of the cut 104, and the like. In various embodiments, the fastener may include strings, cords, hooks, tucking, folding, zip locks, Lego-tape, bristle block tape, and the like. Fasteners may be removably attached to the garment 102 so they may be easily added, replaced, and or exchanged for another fastener type. The garment may also be sold together with one or more fastener types as a kit.

The cuts 104 may also be covered by a layer of fabric that overlaps the cut 104 opening to prevent wind and/or cold air from entering the cuts 104 and making the wearer cold. The layer of fabric may also overlap to cut 104 to prevent inclement weather (e.g., rain, snow, sleet, etc.) from entering the garment 102 through the cuts 104. Cuts 104 included in garments 102 having a layer of fabric that overlaps and/or folds over the cut 104 opening may have a fastener for closing the cut 104 opening. The fastener may be fixed to an edge of one or more of the cuts 104. The layer of fabric may cover the fastener and/or the cut 104 opening. To access the cut 104 opening, the layer of fabric may fold back way from the cut 104 opening to expose the opening. To close the cut 104 opening, the layer of fabric may fold over the cut 104 opening to cover the opening. In various embodiments, the layer of fabric may be used as a replacement for a fastener to cover cut 104 openings that are not attached to a fastener and are otherwise open except for the layer of overlapping fabric. Cut 104 openings may also be open in various garment embodiments that do not have a fastener or a layer of fabric.

Figure 5:
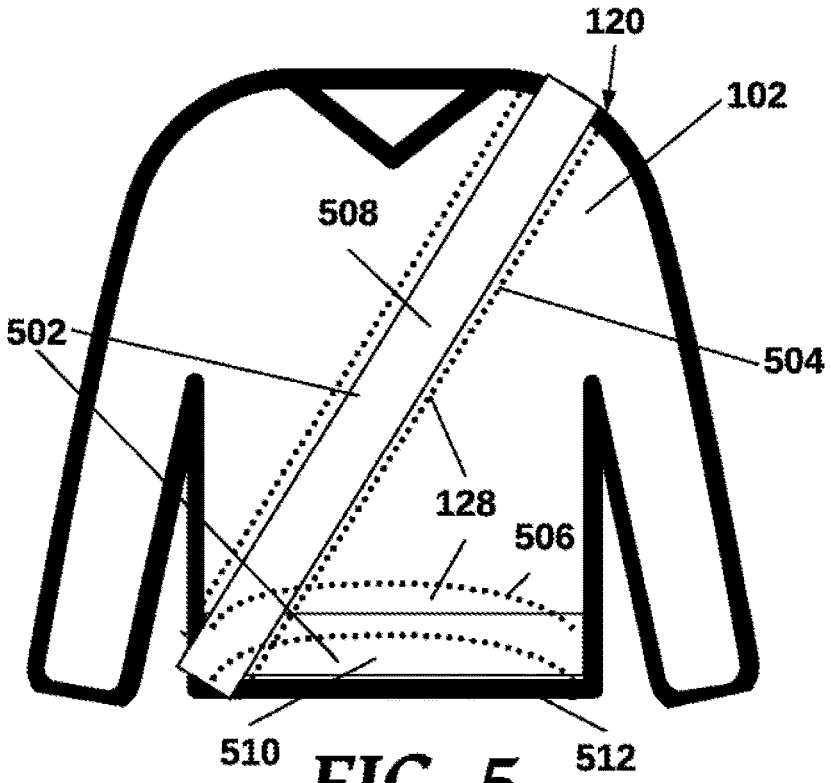
FIG. 5 illustrates the exemplary garment having safety grooves in FIG. 4 and a contact area of a three point harness.

FIG. 2 illustrates a view of the safety grooves included in the garment 102. The safety grooves may be shown in FIG. 2 as dotted lines and may include a first safety groove 126 that extends down the left side of the garment, a second safety groove 130 opposite the first safety groove 126 that extends down the right side of the garment 102, and a third safety groove 132 that may run along a middle portion of the garment 102 to connect the first safety groove 126 and the second safety groove 130. The safety grooves may define a path 128 to contain one or more portions of the harness 106 (e.g., contact areas of a harness 106 that are positioned against the body of a person wearing the harness 106). As shown in FIG. 2, the path 128 may be the area between the doted lines that define each safety groove. The path 128 may be any shape and may generally follow any arrangement of cuts and or safety grooves included in the garment 102. FIG. 5 below illustrates an alternate arrangement of the garment 102 and path 128.

To place the harness 106 beneath the outer layer of the garment 102, the portions of harness 106 may be inserted into the cuts 104 and threaded through the path 128 defined by the first safety groove 126, the second safety groove 130, and the third safety groove 132. In various embodiments, the portions of harness 106 may be placed inside the safety grooves when the harness 106 is buckled or otherwise attached to a structure (e.g., a seat or car seat) to secure the person inside the structure. In various embodiments, the harness 106 may be buckled or otherwise secured to the structure first, then the components may be placed inside the safety grooves and tightened on the person's body or inner layer of clothing. In the embodiment in FIG. 2, the path 128 may include paths for the shoulder straps 110 of the harness 106 and a path for a closure mechanism (e.g., a harness chest clip) 108 of the harness. Thus, as shown in FIG. 2, the harness is this embodiment may have one or more harness shoulder straps 110 that may be placed underneath the outer layer of the garment 102 inside the path 128 defined by the first safety groove 126 and the second safety groove 130. Inserting the harness straps 110 into the first 126 and second 130 safety grooves through the cuts 104 shown in FIG. 1 may also allow the harness closure mechanism 108 to be buckled inside the third safety groove 132 underneath the bulk of the outer layer of the garment 102. Accommodating the harness closure mechanism 108 inside the third safety groove 132 enables a person and/or caregiver to put the harness 106 on a child or their own body without having to undo the center fastener of a coat or other garment 102.

As shown in FIGS. 1-2, using the two cuts 104 and safety grooves, a child wearing the garment 102 can be secured inside a five point harness 106 included in, for example, a car seat without having to remove the child's garment 102 or open the garment's 102 center fastener. The two cuts 104 and safety grooves place the contact areas of the harness underneath the bulk of the garment 102 and close to the body of the person wearing the harness, thereby securing the person inside the harness 106.

In various embodiments, the position of the cuts 104, the number of safety grooves, and or the position of the path may change based on the type of garment 106. For example, the safety grooves and path may track and align with the cuts 104. Therefore, the position of the safety grooves and path may change as the position of the cuts 104 changes. For vests, the cuts 104 and safety grooves may begin on both sides at the arm holes. In various embodiments, the cuts 104 and safety grooves may extend from the top of the arm holes and or sleeves to the back of the shoulder portion 120 of the garment 102 and from the bottom of the arm holes and or sleeves to the bottom hem 124. For shorter coats, the cuts 104 may extend from the back of the shoulder portion 120 to the height of the closure mechanism 108. This shorter cut may require the middle of the garment 102 to be unfastened to secure the harness 106 on the wearer. In various embodiments, the cuts 104 and safety grooves may also increase air flow inside the garment 102, thereby enabling better temperature regulation and improving the comfort of the garment 102.

FIGS. 2 and 3A-B illustrate an exemplary safety groove (e.g., the first safety groove 126) in more detail. The safety groove shown in FIGS. 3A-B is shown as the first safety groove 126 illustrative purposes only. The description of the first safety groove 126 below may be applicable to other safety grooves included in the garment. The other safety grooves may be at any position on the garment 102 and may contain any portion of the harness 106. FIG. 3A illustrates a harness strap 110 resting inside the first safety groove 126. To access the first safety groove 126, the harness strap 110 may be inserted into a cut 104 made in the outer layer of the garment 102. The cut 104 may provide an opening to access the first safety groove 126 and a layer of fabric 302 may cover the opening created by the cut 104. A fastener 304 may be used to open and close the opening in the outer layer of the garment 102 created by the cut 104. In the configuration shown in FIG. 3A, the harness strap 110 may be placed inside the first safety groove 126 with the top portion of the harness strap 110 over the layer of fabric 302 and the bottom portion of the harness strap 110 under the layer of fabric 302. In various embodiments, the entire harness strap 110 may be on top of and/or underneath the layer of fabric 302 when the harness strap 110 is placed inside the safety groove 126. To cover the harness strap 110 and/or other piece of harness 106 inserted into the first safety groove 126 or other safety groove, the layer of fabric 302 may be routed over the harness strap 110 from any direction relative to the harness strap 110 (e.g., from underneath the strap, to the right of the strap, to the left of the strap, and the like). Once the harness strap 110 is positioned inside the safety groove the fastener 304 may be used to close the cut 104 and secure the harness strap 110 inside the safety groove.

In the configuration shown in FIG. 3B, the harness strap 110 may be placed inside the first safety groove 126 under the layer of fabric 302 (shown pulled back) and over the liner 306 built into the garment 102. In various embodiments, the layer of fabric 302 may tuck into a flap to help maintain the shape of the garment 102 and restrict the flow of air through the cut 104. The layer of fabric 302 may also be easily pulled back from the cut 104 to allow access to the safety grooves in one fluid motion. Optionally, the layer of fabric 302 may be fixed to a fastener. The fastener on the layer of fabric 302 may be used to secure the layer of fabric 302 over the cut 104 and/or a piece of harness 106 placed inside the safety groove. Securing the layer of fabric 302 over the cut may camouflage the cut and/or the piece of harness 106 inside the first safety groove 126 to help the garment 102 maintain its shape and appearance. Once secured over the cut 104, the layer of fabric 302 may prevent or reduce air flow inside the garment 102 to better insulate body heat.

The liner 306 may be the inner layer of the garment 102 that forms an inner surface of the first safety groove 126 so that the portions of harness 106 placed inside the safety grooves may be positioned between the outer layer of the garment 102 and the liner 306. To accommodate portions of harness 106 inside the safety groove 306, the fastener 304 may be used to open the cut 104. Once the cut 104 is open, the layer of fabric 302 may be pulled back to uncover the opening in the garment 102 created by the cut. The portions of harness 106 may then be inserted into the first safety groove 126 or other safety grooves over the liner 306. To secure the portions of harness inside the first safety groove 126 or other safety grooves, the fastener 304 may be used to close the opening in the garment 102 created by the cut 104 and the layer of fabric 302 may be pulled back over the opening to cover the cut 104.

Figure 3C:
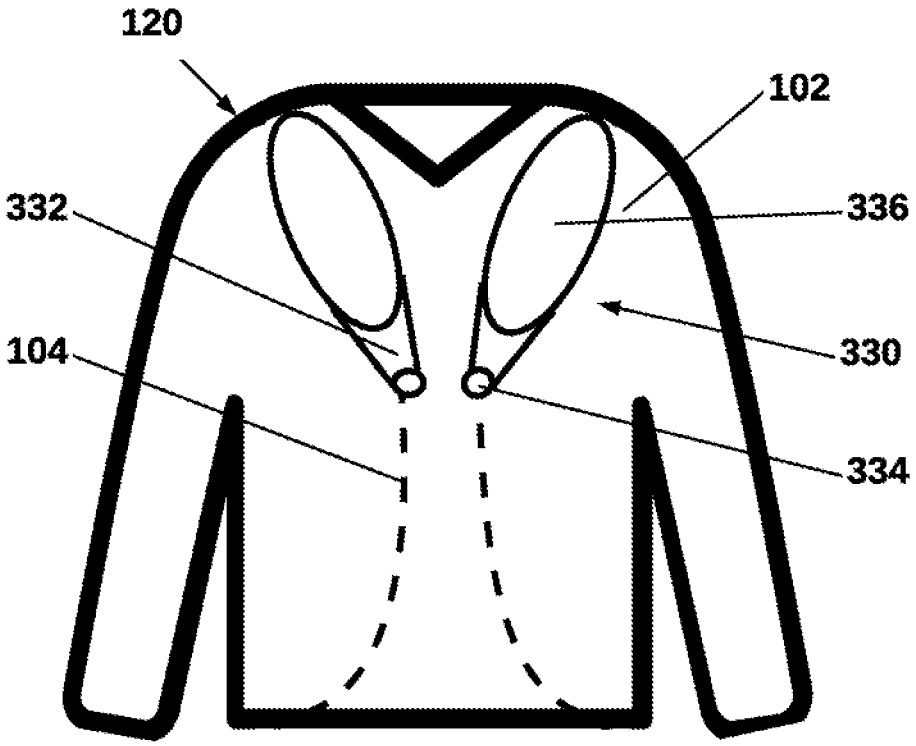
FIG. 3C illustrates an exemplary garment having a collar for covering a safety groove.

As shown in FIG. 3C, in various embodiments, the layer of fabric 302 may be configured as a collar 330 that extends down from a shoulder portion 120 of the garment 102. The collar 330 may cover a portion and/or all of the cut 104. The collar 330 may be fixed to the cut using any known fastener including snaps, buttons, Velcro, and the like and/or the collar may be loose on the garment 102. In various embodiments, the collar 330 may be removably attached to the garment allowing the collar 330 to be completely removed. The collar 330 may provide additional warmth and comfort by covering the opening in the garment 102 created by the cut 104.

In various embodiments, the collar 330 may be converted to different arrangements to provide additional functionality. In a first collar configuration, the collar 330 may include a lower extension 332 that may be attached to the main portion 336 of the collar 330 using a snap 334 (or any known fastener) fixed to the end of the lower extension 332. The lower extension 332 may extend from any part of the main portion 336 including a middle part, upper part, lower part, and the like. The lower extension 332 may be fixed to each collar 330 that extends down from the shoulder portion 120 of the garment 102. The lower extension 332 may include an accordion style cut of material that extends out from the main portion 336 of the collar 330 in any direction relative to the main portion 336 including to the right of the main portion 336, to the left of the main portion 336, below the main portion 336, above the main portion 336, and the like. When in the first configuration, the collar 330 and the lower extension 332 may be wrapped around the neck of the person wearing the garment 102 and function as a scarf. The snaps 334 may secure the two sections of the collar 330 together to secure the two section of collar 330 as a scarf around the person's neck.

In a second configuration, the collar 330 and the lower extension 332 may be wrapped around the head and over the ears of the person wearing the garment 102 and function as a head wrap. The snaps 334 may fix the two sections of the collar 330 together to secure the two section of collar on top of the person's head as a head wrap. In a third configuration, the collar 330 may be flipped over the shoulder portion 120 to rest on the back side of the garment. In the third configuration, the collar 330 may form a back panel that helps keep the person warm inside the garment 102. The main body 336 of the collar 330 may also include one or more pockets that enable the wearer to store items in the collar 330 when the collar 330 is over the front side and/or the back side of the garment 102. When the collar 330 is over the back side of the garment 102 the one or more pockets may function as a pocket backpack. In a fourth configuration, the collar 330 may be fixed to the liner inside the safety grooves to create a traditional hood when the two sections of collar 330 are placed over the head of the wearer. In various embodiments, the fourth collar configuration may be independent from the liner and/or safety groove. The collar 330 may include its own liner or other layer of material for forming the backside of the hood. The hood may be rolled up and placed at the nape of the neck of the wearer as an additional layer of material separating the person from their seat. When arranged in the fourth configuration the collar 330 may give the person support, comfort, and safety while they sit inside a harness.

In a fifth configuration, the collar 330 may be completely removed from the garment 102 to function as an insulated bag. A carrying device, for example, a strap, handle, belt loop clip and/or attachment, and the like, may be fixed to the collar 330 to make the bag easier to carry. In various embodiments, the fifth collar configuration may be arranged as a bag without a handle and/or other carrying device. The bag created by the removed collar may be used to carry any object that fits inside the bag and may be especially useful for carrying items that require and/or could benefit from temperature regulation including, for example, food, medication, and the like. The collar 330 may also have one or more additional configurations that enable the collar 330 to function as a travel pillow, travel pillowcase, diaper changing pad, bib, seat cushion to place over a bleacher, bench, chair, and the like, a chest warmer, a baby blanket and the like.

Figure 4:
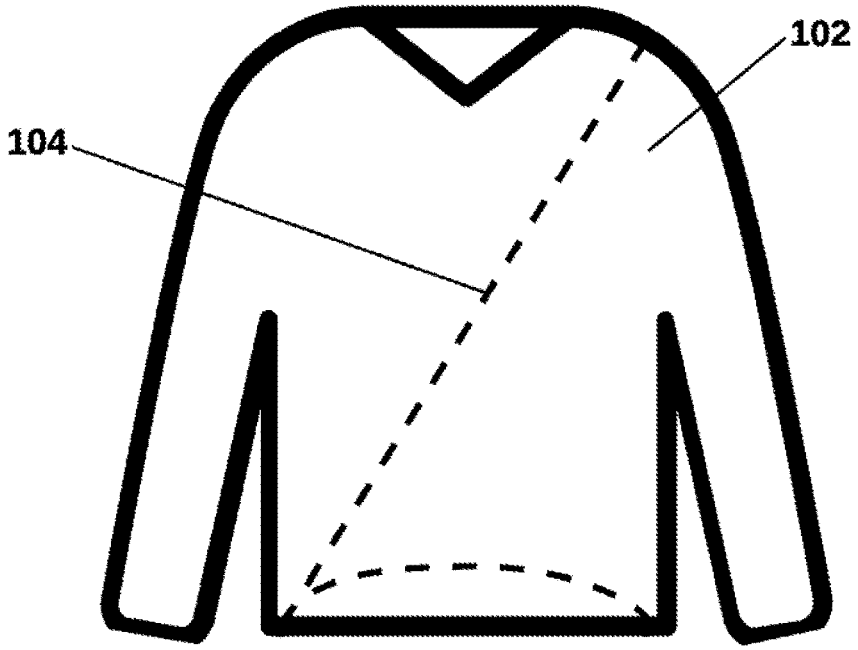
FIG. 4 illustrates a second embodiment of an exemplary garment having safety grooves.

FIG. 4 illustrates a second embodiment of the garment 102 having one or more cuts 104 made into the outer layer of the garment. In this embodiment, the one or more cuts 104 may be positioned to enable the garment to accommodate a three point harness, for example, a seat belt. As shown in FIG. 4, the first cut may be a diagonal cut extending from the back of one shoulder portion of the garment diagonally across the torso section of the garment and terminate at a waist portion of the garment opposite the shoulder portion. A second cut may be a horizontal cut extending across the waist portion of the garment. The cuts 104 may be curved to allow harness straps to sit flush against an inner layer of clothing and/or the body of the person wearing the garment 102. In various embodiments, two or more cuts may be made into the garment at other positions to accommodate different configurations of the three point harness 502 as shown in FIG. 5. Shorter garments that do not extend below the waist may only have the diagonal cut for accommodating a three piece harness.

As shown in FIG. 5, the garment 102 may include one or more safety grooves that define a path 128 beneath the outer layer of the garment 102 to insert a portion of the three piece harness 502. The safety grooves may be shown in FIG. 5 as dotted lines and may include a diagonal safety groove 504 that extends from the bottom seam 512 of the garment 102 across the middle portion of the garment to the shoulder portion 120 of the garment opposite the bottom seam and a horizontal safety groove 128 that extends horizontally across the bottom of the garment 102 just above the bottom seam 512 and connects to the lower end of the diagonal safety groove 504. The safety grooves may define a path 128 to contain one or more portions of the three piece harness 502 (e.g., contact areas of the three piece harness 502 that are positioned against the body of a person wearing the three piece harness 502). As shown in FIG. 5, the path 128 may be the area between the doted lines that define each safety groove.

The safety grooves may be accessed through the cuts 104 made in the outer layer of the garment 102. To accommodate the three piece harness 502, the shoulder strap 508 of the three piece harness is inserted into the diagonal cut and placed inside a diagonal safety groove 504 that tracks the diagonal cut. The waist strap 510 of the three piece harness 502 is then inserted into the horizontal cut and placed inside a horizontal safety groove 506 that tracks the horizontal cut. In various embodiments, the three piece harness 502 may be buckled inside the safety grooves at the intersection of the diagonal safety groove 504 and the horizontal safety groove 506. This configuration allows the three piece harness 502 to be buckled without removing the garment 102 or opening the garment's center fastener. The waist portion of shorter garments may not reach or exceed the horizontal strap 510 of a three piece harness 502, therefore only a diagonal cut may be included in shorter garments. As in the previous embodiment, the garment 102 may have the fabric layer 302 and/or fastener associated with the cuts 104.

Figure 6:
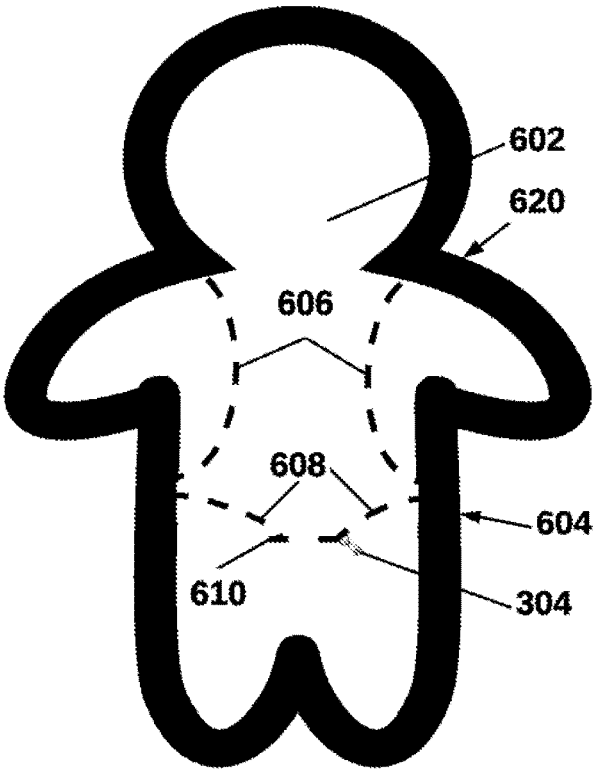
FIG. 6 illustrates a third embodiment of an exemplary garment having safety grooves.
Figure 7:
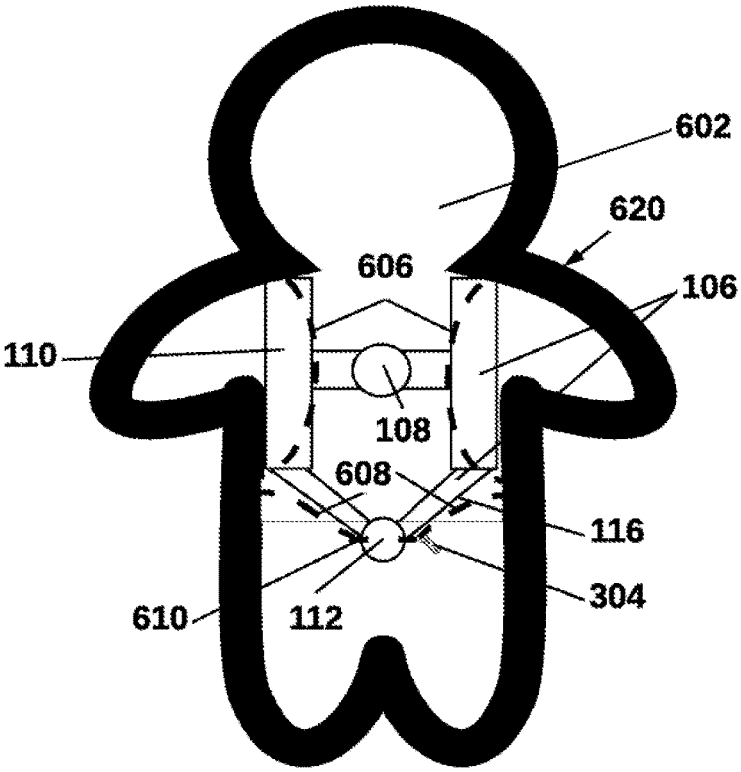
FIG. 7 illustrates the exemplary garment having safety grooves in FIG. 6 and a contact area of a five point harness.

FIGS. 6-7 illustrate an embodiment of an extended garment 602 configured to extend beyond the waistline 132 of the wearer. The extended garment 602 may have one or more cuts made into the outer layer of the extended garment 602. The cuts may give access to one or more safety grooves positioned beneath the outer layer of the extended garment 602 as shown in FIG. 7. The extended garment 602 in this embodiment may include five cuts positioned to accommodate a five point harness 106. The extended garment 602 may include two vertical cuts 606 running along opposite sides of the extended garment 602. The vertical cuts 606 may extend from the back of the shoulder portion 620 of the extended garment 602 down the torso section of the extended garment 602. The extended garment 602 may include two lower diagonal cuts 608 extending from the torso section across the waistline 602 of the extended garment 602 to insert a lower portion of the harness 106 that secures the lower body of the wearer. The vertical cuts 606 and/or the lower diagonal cuts 608 may curve outwardly to allow harness straps 110 and or the lower harness straps 116 to sit flush against an inner layer of clothing and/or the body of the person wearing the extended garment 602. The two lower diagonal cuts 608 may intersect a short horizontal cut 610 at the center of the extended garment 602 below the waistline 604 to accommodate a lower closure mechanism (e.g., a center harness clip) 112 included in the five point harness 106.

As shown in FIG. 7, to accommodate a five point harness, the harness straps 110 are inserted inside the vertical cuts 606 and placed inside safety grooves that track and align with the vertical cuts 606. The harness closure mechanism 108 may be buckled inside the safety grooves to enable the person wearing the harness 106 and/or a caregiver to buckle the closure mechanism 108 without removing the extended garment 602 and/or opening the extended garment's center fastener. The lower harness straps 116 and the lower closure mechanism 112 may be inserted into a safety grooves that track the two lower diagonal cuts 608 and the short horizontal cut 610 to secure the person inside the five point harness 106. The lower closure mechanism 112 may be buckled inside the safety groves to enable the person wearing the harness 106 and/or a caregiver to buckle the lower closure mechanism 112 without removing the extended garment 602 and/or opening the extended garment's center fastener. In various embodiments, additional cuts may be made in the extended garment 602 along with corresponding safety grooves tracking the additional cuts to allow other portions of harnesses to fit tighter against the body and/or inner layer of clothing of the person wearing the harness 106. The one or more cuts may include a fastener 304 that may enable a user to open and close the one or more cuts to access and restrict access to the safety grooves. The fastener 304 may be fixed to the edge of one or more of the cuts.

Figure 8:
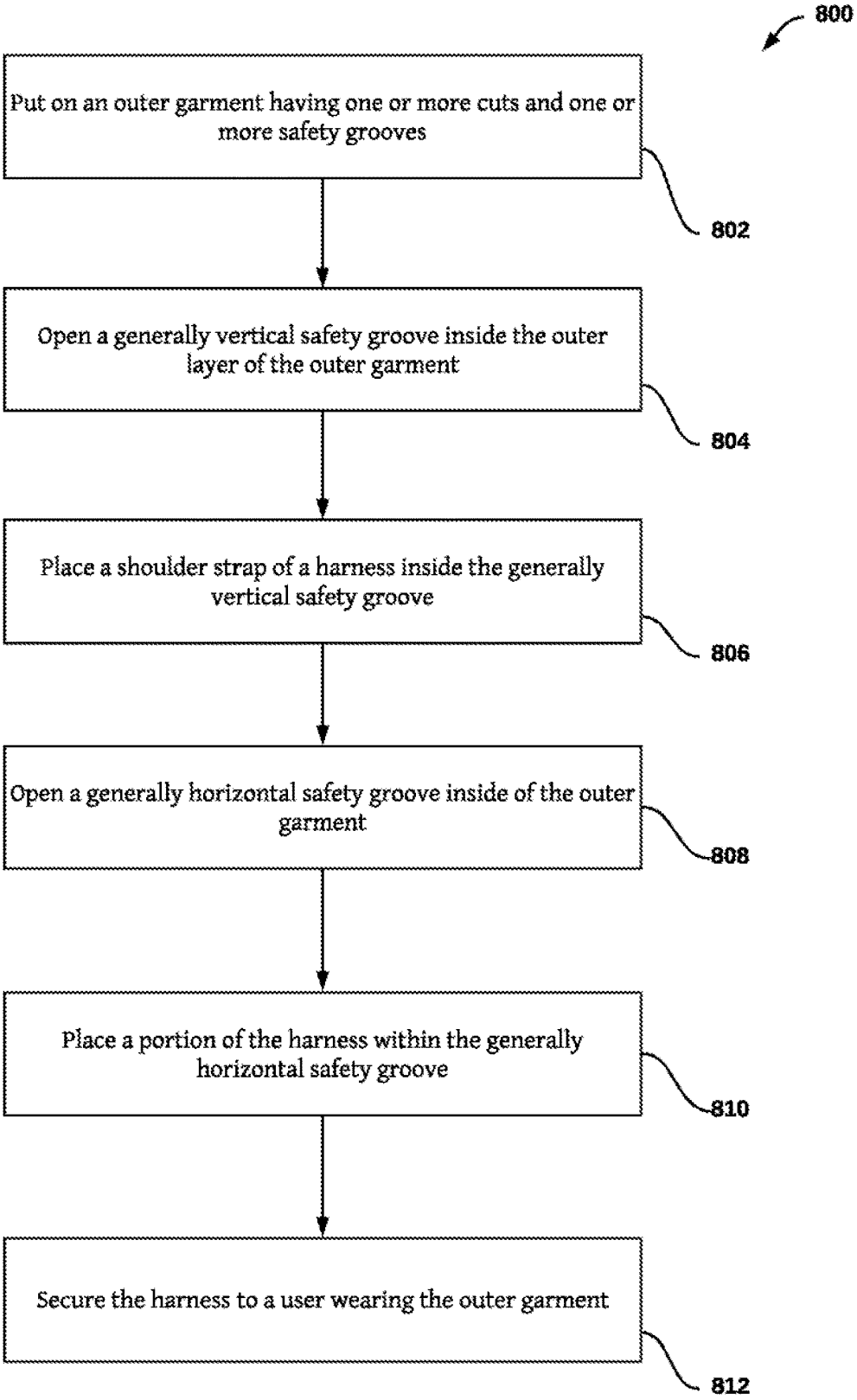
FIG. 8 is a flow chart illustrating a method for securing a person wearing the garment into a harness.

FIG. 8. Illustrates an exemplary method 800 for securing a person wearing a garment into a harness. At step 802, a person puts on a garment having one or more cuts and one or more safety grooves. At step 804, a generally vertical safety groove inside of the garment is opened. In various embodiments, a safety groove may be opened by separating a cut in the garment. A shoulder strap of a harness is then placed within the generally vertical safety groove, at step 806. For harnesses having two or more shoulder straps, one or more additional generally vertical safety grooves inside the garment may be opened and the one or more additional shoulder straps may be placed inside the additional generally vertical safety groves. At step 808, a generally horizontal safety groove inside of the garment is opened. A portion of the harness is then placed within the generally horizontal safety groove, at step 810.

At step 812, the harness is secured to a user wearing the garment. For harnesses having a closure mechanism, the harness may be secured to the person by closing the closure mechanism (e.g., by buckling a clip and/or buckle closure mechanism). In various embodiments, the closure mechanism may be placed inside the safety groove before or after the harness is attached to the person (e.g., bucked or otherwise attached to a seat, car seat or other structure including the harness and containing the person). To reduce the amount of material separating the harness from the body and/or an inner layer of clothing of the person wearing the harness, the harness may be secured with the shoulder strap and the portion of the harness inside of the garment and closer to the user.

In the above detailed description, numerous specific details are set forth in order to provide a sufficient understanding of the subject matter presented herein. But it will be apparent to one of ordinary skill in the art that the subject matter may be practiced without these specific details. Moreover, the particular embodiments described herein are provided by way of example and should not be used to limit the scope of the invention to these particular embodiments.

The present disclosure describes various embodiments of a garment and safety features that may be included in the garment. In various embodiments, the garment including safety features described herein may provide improved aesthetics, safety, compatibility with a harness, comfort, convenience, durability, weight, wear-ability and/or safety feature concealment and/or arrangement over other garments.

Certain details are set forth in the following description and in FIGS. 1-8 to provide a thorough understanding of various embodiments of the present invention. Other details describing well-known structures and systems often associated with garments, harnesses, fasteners, etc., however, are not set forth below to avoid unnecessarily obscuring the description of the various embodiments of the present invention.

Many of the details, dimensions, angles and other features shown in FIGS. 1-8 are merely illustrative of particular embodiments of the present invention. Accordingly, other embodiments may include other details, dimensions, angles and features without departing from the spirit or scope of the present invention. In addition, those of ordinary skill in the art will appreciate that further embodiments of systems described herein may be practiced without several of the details described below. Various embodiments of the present invention may also include structures other than those illustrated in the figures and are expressly not limited to the structures shown in the figures. Moreover, the various elements and features illustrated in the figures may not be drawn to scale. In the figures, identical reference numbers identify identical or at least generally similar elements. To facilitate the discussion of any particular element, the most significant digit or digits of any reference number refers to the figure in which that element is first introduced. For example, element 104 is first introduced and discussed with reference to FIG. 1.

As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Spatially relative terms, such as "beneath", "below", "lower", "above", "upper", "front", "rear", "interior", "exterior", and the like, may be used herein for ease of description to describe one element or feature's relationship to another element(s) or feature(s) as illustrated in the figures. It will be understood that the spatially relative terms are intended to encompass different orientations of the garment in use or operation in addition to the orientation depicted in the figures. For example, if the garment in the figures is turned over or inverted, elements described as "below" or "beneath" other elements or features could then be oriented "above" the other elements or features. Thus, term such as "below" may encompass both an orientation of above and below. The garment may be otherwise oriented (rotated 90 degrees or at other orientations) and the spatially relative descriptors used herein are interpreted accordingly.

Although the terms first, second, etc. may be used herein to describe various configurations, elements, components, regions, layers and/or sections, it should be understood that these configurations, elements, components, regions, layers and/or sections should not be limited by these terms. These terms are used only to distinguish one configuration, element, component, region, layer, or section from another region, layer, or section. Thus, a first configuration, element, component, region, layer, or section discussed below could be termed a second configuration, element, component, region, layer, or section without departing from the teachings of the present invention.

As used herein, the terms "and/or" and "at least one of" include any and all combinations of one or more of the associated listed items.

References throughout the foregoing description to features, advantages, or similar language do not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the present invention may be combined in any suitable manner in one or more embodiments. One skilled in the relevant art will recognize that the present invention can be practiced without one or more of the specific features or advantages of a particular embodiment. In other instances, additional features and advantages may be recognized in certain embodiments that may not be present in all embodiments of the present invention.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof means any connection or coupling, either direct or indirect, between two or more elements; the coupling or connection between the elements can be physical, logical, or a combination thereof. Additionally, the words "herein," "above," "below," and words of similar import, when used in this application, refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

Although certain aspects of the invention are presented below in certain claim forms, the applicant contemplates the various aspects of the invention in any number of claim forms. Accordingly, the applicant reserves the right to pursue additional claims after filing this application to pursue such additional claim forms, in either this application or in a continuing application.

The invention claimed is:

1. A garment comprising:

an outer layer having one or more cuts made in the outer layer, the one or more cuts including at least a first cut, a second cut, and a third cut, wherein the first cut and the second cut are each disposed longitudinally along a front of the garment from a shoulder portion of the garment to a bottom hem of the garment and extending from the outer layer to an inner layer of the garment, wherein the third cut is disposed along a mid-section of the front of the garment and oriented perpendicular to the first cut and the second cut, and wherein the third cut connects to each of the first cut and the second cut; and at least a first safety groove accessible through a first opening exposed by the first cut, a second safety groove accessible through a second opening exposed by the second cut, and a third safety groove accessible through a third opening exposed by the third cut that connects the first safety groove to the second safety groove, wherein each of the first safety groove and the second safety groove extend from the shoulder portion to the bottom hem at opposing sides of the front of the garment, wherein the first safety groove, the second safety groove, and the third safety groove are defined by a lined track sewn to an interior of the garment and each are configured to accommodate one or more portions of a harness along the lined tracks sewn to the interior of the garment, wherein the inner layer comprises a thickness that is less than a thickness of the outer layer.

2. The garment of claim 1, wherein the inner layer is attached to the outer layer, the inner layer forming an inner surface of the first safety groove and the second safety groove so that the first safety groove and the second safety groove are between the outer layer and the inner layer.

3. The garment of claim 2, wherein the inner layer is configured to directly contact a portion of a body of a person or another article of clothing.

4. The garment of claim 1, further comprising a fastener fixed to an edge of each of the one or more cuts, wherein the fastener is configured to close the one or more cuts to restrict access to the first safety groove and the second safety groove.

5. The garment of claim 1, further comprising a layer of fabric fixed to the outer layer near each of the one or more cuts.

6. The garment of claim 5, wherein the layer of fabric extends over an opening in the outer layer created by the one or more cuts to maintain a shape of the garment and restrict air flow through the one or more cuts.

7. The garment of claim 5, wherein the layer of fabric folds back away from an opening in the outer layer created by the one or more cuts to expose the one or more cuts, which is configured to allow the harness to be inserted into the first safety groove and the second safety groove.

8. The garment of claim 1, wherein the one or more cuts are curved, which is configured to allow the contact area to sit flush against a portion of a body of a person or an inner layer of clothing worn by the person.

9. A garment comprising:

an outer layer having a first cut, a second cut, and a third cut, the first cut and the second cut being disposed longitudinally along a front of the garment from a shoulder portion of the garment to a bottom hem of the garment, wherein the third cut is disposed along a mid-section of the front of the garment and oriented perpendicular to the first cut and the second cut;

a first safety groove accessible through a first opening exposed by the first cut;

a second safety groove accessible through a second opening exposed by the second cut, wherein each of the first safety groove and the second safety groove extend from the shoulder portion to the bottom hem at opposing sides of the garment; and a third safety groove accessible through a third opening exposed by the third cut and connecting the first safety groove portion and the second safety groove portion, wherein the first safety groove, the second safety groove, and the third safety groove are defined by a lined track sewn to an interior of the garment along each of the first cut and the second cut and each configured to accommodate a contact area of a harness along the lined tracks sewn to the interior of the garment.

10. The garment of claim 9, wherein the third safety groove extends horizontally between the first safety groove and the second safety groove across a torso section of the garment.

11. The garment of claim 9, wherein the garment is configured to receive a five point harness by:

placing a first harness strap inside the first safety groove;

placing a second harness strap inside the second safety groove; and placing a harness chest clip inside the third safety groove.

12. The garment of claim 11, wherein the first safety groove, the second safety groove, and the third safety groove allow the harness chest clip to be buckled beneath the outer layer without removing the garment or opening a center fastener of the garment.

* * * * *